United States Patent [19]

Ochi et al.

[11] Patent Number: 4,893,564

[45] Date of Patent: Jan. 16, 1990

[54] ELECTRIC DETONATOR OF DELAY TYPE

[75] Inventors: Koji Ochi, Iwamizawa; Masahide Harada, Sapporo, both of Japan

[73] Assignees: Nippon Oil & Fats Co., Ltd., Japan; Harada Electronics Industry, Japan

[21] Appl. No.: 256,642

[22] Filed: Oct. 12, 1988

[30] Foreign Application Priority Data

Oct. 20, 1987 [JP] Japan ..... 62-262810

[51] Int. Cl.[4] ..... F42C 11/00

[52] U.S. Cl. ..... 102/218; 102/202.1; 102/206

[58] Field of Search ..... 102/202.1, 206, 218, 102/220

[56] References Cited

U.S. PATENT DOCUMENTS

| | | | |
|---|---|---|---|
| 3,598,055 | 8/1971 | Gunderson | 102/220 |
| 3,964,395 | 6/1976 | Kaiser et al. | 102/220 |
| 4,145,970 | 3/1979 | Hedberg et al. | 102/218 |
| 4,586,437 | 5/1986 | Miki et al. | 102/220 |
| 4,712,477 | 12/1987 | Aikou et al. | 102/206 |

FOREIGN PATENT DOCUMENTS

| | | |
|---|---|---|
| DE 2259378 | 7/1978 | Fed. Rep. of Germany . |
| DE 2916601 | 5/1988 | Fed. Rep. of Germany . |

*Primary Examiner*—Charles T. Jordan

*Attorney, Agent, or Firm*—Arnold, White & Durkee

[57] ABSTRACT

An electric detonator of delay type including leg wires connectable to bus wires, a capacitor connected across the leg wires for storing the electric energy supplied from an electric blaster via the leg wires, a delay circuit connected across the leg wires and generating an igniting signal at a predetermined timing, a switching circuit and an igniting resistor connected to the switching circuit, whereby the switching circuit is made conductive in response to the igniting signal to discharge the electric energy stored in the capacitor through the igniting resistor to explode the detonator. In order to operate the detonator reliably and safely, there are provided low and high voltage protection circuits for discharging the electric energy therethrough when the power supply voltage is out of a predetermined normal operation range.

4 Claims, 3 Drawing Sheets

ELECTRIC DETONATOR OF DELAY TYPE

BACKGROUND OF THE INVENTION

Field of the Invention and Related Art Statement

The present invention generally relates to an electric detonator of delay type, and more particularly, to an electric detonator which is preferably used in a multi-step explosion in which a number of explosives are ignited at different timings.

A known electric detonator of delay type comprises a pair of leg wires connectable to bus wires which are connected to an electric blaster, a capacitor for storing electric energy, an electric delay circuit including an electronic delay element and an electronic switching element, and an electric igniting portion including an igniting resistor and a fuse head applied thereon. At first, the electric energy is stored in the capacitor and at a predetermined timing after the electric blaster has been stopped, the switching element is made conductive and the electric energy stored in the capacitor is discharged through the igniting resistor to ignite the detonator.

In the known electric detonator of delay type, it is very important that the amount of electric energy stored in the capacitor, i.e. the terminal voltage across the capacitor, is in a normal operation range. That is to say, when the terminal voltage across the capacitor is lower than the lowest voltage of said normal operation range, even if the blaster is actuated, a sufficiently large current does not flow through the igniting resistor and the detonator is not exploded. To the contrary, when the terminal voltage across the capacitor exceeds the highest voltage of the normal operation range, the electronic delay circuit might not work satisfactorily. Particularly, when the leg wires are erroneously connected to the domestic power supply line, i.e. to A.C. 100 V socket, the electronic delay circuit might be broken, and in the worst case, the detonator might be exploded accidentally.

Heretofore, the safeguard is effected only given the caution or warning that the detonator should never be connected to supply sources other than the specified one. However, this measure is not sufficient for providing the protection against the mis-operation.

SUMMARY OF THE INVENTION

The present invention has for its object to provide a novel and useful electric detonator of delay type which can be exploded always under a voltage within the normal operation range and can be exploded reliably and safely.

According to the invention, an electric detonator of delay type comprises;

a pair of leg wires which are connectable to bus wires connected to a blaster;

a capacitor connected across said leg wires and storing the electric energy supplied from the blaster via the bus wires and the leg wires;

a delay circuit connected to be energized by a terminal voltage generated across said capacitor and generating an igniting signal at a predetermined timing;

a switching circuit connected to be made conductive upon receipt of said igniting signal from said delay circuit and constituting a discharge passage for the electric energy stored in said capacitor;

an igniting resistor connected in said discharge passage and igniting the detonator when the electric energy is discharged through the discharge passage;

a low voltage protection circuit connected across the leg wires and discharging the electric energy stored in the capacitor, when a power supply voltage applied across the leg wires is smaller than the lowest voltage of a normal operation range; and a high voltage protection circuit connected across the leg wires and discharging said electric energy stored in the capacitor when the power supply voltage exceeds the highest voltage of the normal operation range and supplying to said delay circuit an inhibit signal which inhibits a time counting operation of the delay circuit for determining said predetermined timing.

DESCRIPTION OF THE PREFERRED EMBODIMENT

Figure 1:
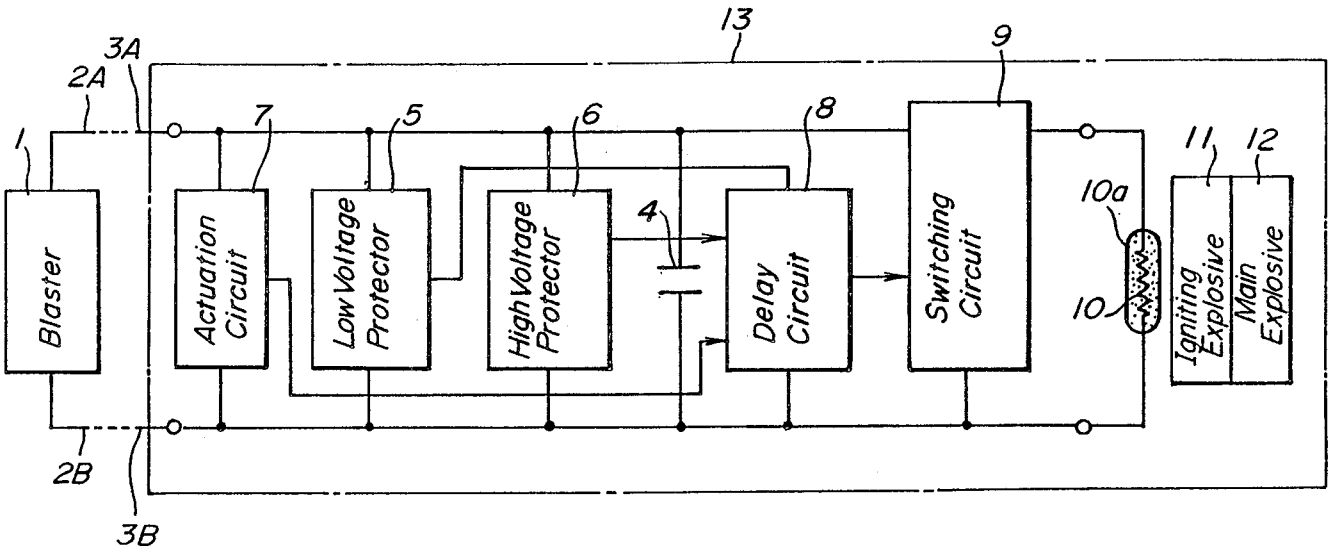
FIG. 1 is a block diagram showing an embodiment of the electric detonator of delay type according to the invention.

FIG. 1 is a block diagram showing the basic construction of the electric detonator of delay type according to the invention, the detonator comprises a pair of leg wires 3A and 3B connectable to bus wires 2A and 2B which are connected to an electric blaster 1, a capacitor 4, a low voltage protection circuit 5, high voltage protection circuit 6, and an actuation circuit 7, these circuits being connected across the leg wires 3A and 3B, a delay circuit 8 triggered by an actuation signal supplied from the actuation circuit 7, a switching circuit 9 driven by an igniting signal supplied from the delay circuit 8, an igniting resistor 10 having a fuse head **10*a* applied thereon and connected to the switching circuit 9, a igniting explosive 11 and a main explosive 12. The above mentioned elements are installed in a housing 13, and the leg wires 3A and 3B are extended out of the housing. The low voltage protection circuit 5 serves to discharge the electric energy stored in the capacitor 4, when the power supply voltage applied from the blaster via the bus wires 2A, 2B and leg wires 3A, 3B is lower than the lowest voltage of a normal operation range. The high voltage protection circuit 6 serves to discharge the electric energy when the power supply voltage exceeds the highest voltage of the normal operation range as well as to supply to the delay circuit 8** an inhibit signal for inhibiting the time counting operation in the delay circuit.

Now the operation of the detonator shown in FIG. 1 will be explained in detail.

Figure 2A:
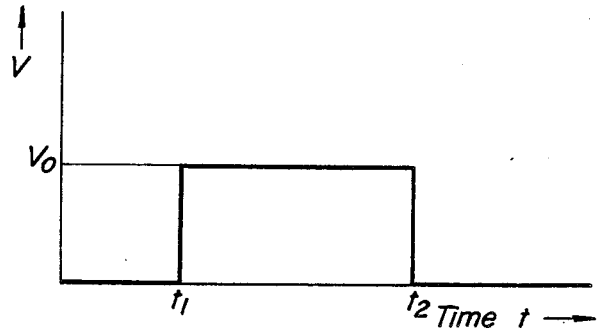
FIG. 2A is a graph showing the power supply voltage applied from the blaster.
Figure 2B:
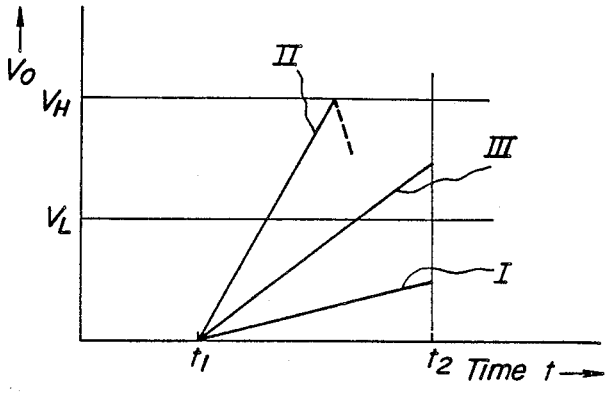
FIG. 2B is a graph representing the variation of the terminal voltage generated across the capacitor.

The electric energy supplied from the blaster 1 via the bus wires 2A, 2B and leg wires 3A, 3B is stored in the capacitor 4. That is to say, as illustrated in FIG. 2A, the power supply voltage $V_0$ is applied to the capacitor 4 from the blaster 1 for a period $t_1-t_2$. The terminal voltage across the capacitor increases as shown in FIG. 2B. When the terminal voltage across the capacitor 4 does not exceed the lowest voltage $V_L$ of the normal operation range at the timing $t_2$ as illustrated by a curve I in FIG. 2B, the low voltage protection circuit 5 is operated to discharge the electric energy stored therein. In this case, the delay circuit 8 is not operated because the electric energy stored in the capacitor 4 is not supplied to the delay circuit via the low voltage protection circuit 5. To the contrary, when the terminal voltage across the capacitor 4 exceeds the highest voltage $V_H$ of the normal operation range during the time period $t_1-t_2$ as shown by a curve II in FIG. 2B, the high voltage protection circuit 6 is operated to discharge the electric energy stored in the capacitor and to supply the inhibit signal to the delay circuit 8. Then, in the delay circuit 8, the time counting operation is forcedly stopped, so that the delay circuit does not generate the igniting signal. Therefore, in the above mentioned two cases, the electric detonator is not exploded.

When the terminal voltage across the capacitor 4 is within the normal operation range as represented by a curve III in FIG. 2B, both the low voltage protection circuit 5 and high voltage protection circuit 6 are not operated at all, so that the delay circuit 8 is actuated by the actuating signal which is generated at the timing $t_2$ by the actuation circuit 7 when the supply voltage is stopped. The delay circuit 8 operates normally and the detonator is exploded at a predetermined timing. For instance, the delay circuit 8 comprises a clock pulse generator for generating clock pulses having a constant repetition frequency and a counter which initiates to count the clock pulses in response to the actuation signal and generates the igniting signal when the counter has counted the given number of clock pulses. The switching circuit 9 is made conductive by means of the igniting signal and the electric charge stored in the capacitor 4 is discharged through the igniting resistor 10. In the manner explained above, the electric detonator according to the invention is operated normally only when the power supply voltage is within the normal operation range, so that the explosion can be carried out reliably and safely.

Figure 3:
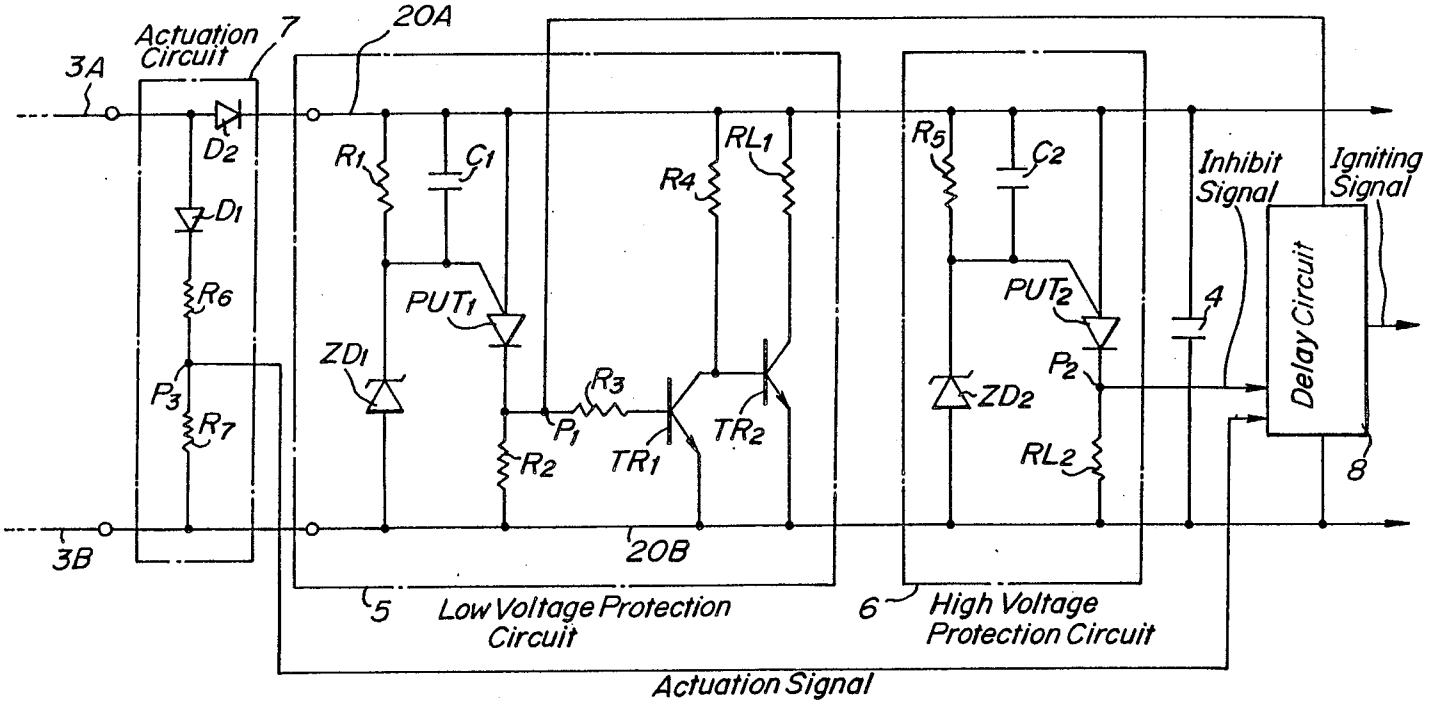
FIG. 3 is a circuit diagram illustrating the detailed construction of the high and low voltage protection circuits according to the invention.

FIG. 3 is a circuit diagram illustrating the detailed construction of the detonator shown in FIG. 1.

The low voltage protection circuit 5 comprises a resistor $R_1$ and a capacitor $C_1$ whose terminals are connected to a first main conductor 20A connected to the leg wire 3A, a zener diode $ZD_1$ connected between a common junction point of the other ends of the resistor $R_1$ and capacitor $C_1$ and a second main conductor 20B connected to the leg wire 3B, said zener diode having the zener voltage of, for instance 27V, a programmable unijunction transistor (hereinafter referred to PUT) $PUT_1$ having a first base connected to the first main conductor 20A, a second base connected to the common junction point of the resistor $R_1$, capacitor $C_1$ and zener diode $ZD_1$, and an emitter coupled with the second main conductor 20B via a resistor $R_2$, NPN type transistor $TR_1$ having a base connected to a junction point between the emitter of $PUT_1$ and resistor $R_2$ by means of a resistor $R_3$, an emitter connected to the second main conductor 20B, and a collector coupled with the first main conductor 20A via a resistor $R_4$, and NPN type transistor $TR_2$ having a base connected to the collector of $TR_1$, an emitter connected to the second main conductor 20B, and a collector coupled with the first main conductor 20A by means of a load resistor $RL_1$.

The high voltage protection circuit 6 comprises a zener diode $ZD_2$ having the zener voltage of 39 V and connected between the second main conductor 20B and a common junction point of one ends of resistor $R_5$ and capacitor $C_2$ whose other ends are connected to the first main conductor 20A, and $PUT_2$ having a first base connected to the first main conductor 20A, a second base connected to the common junction point of the resistor $R_5$, capacitor $C_2$ and zener diode $ZD_2$, and an emitter coupled with the second main conductor 20B via a load resistor $RL_2$.

The actuation circuit 7 comprises a series circuit of diode $D_1$ and resistors $R_6$ and $R_7$ connected across the first and second leg wires 3A and 3B, and a diode $D_2$ connected between the first leg wire 3A and the first main conductor 20A.

When the electric blaster 1 is actuated, the power supply voltage is applied across the first and second main conductors 20A and 20B via the bus wires 2A, 2B and leg wires 3A, 3B. If this voltage is lower than a predetermined value, i.e. the zener voltage 27 V of the zener diode $ZD_1$ in the low voltage protection circuit 5, the zener diode $ZD_1$ is not made conductive. Therefore, $PUT_1$ remains in the OFF condition and a base current of the transistor $TR_1$ does not flow, so that this transistor $TR_1$ is kept non-conductive. Therefore, the base current of the transistor $TR_2$ flows and this transistor is made conductive. This results in that the electric energy stored in the capacitor 4 being discharged through the resistor $RL_1$ having a low resistance and the transistor $TR_2$. In this case, the power supply voltage, i.e. the electric energy stored in the capacitor 4 is not supplied from an output terminal $P_1$ of the low voltage protection circuit 5 to the delay circuit 8, so that the delay circuit does not operate. In the high voltage protection circuit 6, since the power supply voltage is lower than the zener voltage (39 V) of the zener diode $ZD_2$, this zener diode is not made conductive, and thus $PUT_2$ also remains non-conductive. Therefore, the high voltage protection circuit 6 does not operate.

When the power supply voltage exceeds the zener voltage (39 V) of the zener diode $ZD_2$ of the high voltage protection circuit 6, the high voltage protection circuit operates as follows. Since the zener diode $ZD_2$ is made conductive, the base voltage is applied to $PUT_2$, so that $PUT_2$ is made conductive. Therefore, the electric energy stored in the capacitor 4 is discharged through the load resistor $RL_2$ having a low resistance and $PUT_2$. At the same time, the inhibit signal is supplied from the junction point $P_2$ of the resistor $RL_2$ and $PUT_2$ to the delay circuit 8. Then, the delay circuit 8 stops its time counting operation. It should be noted that since $PUT_2$ has the self-holding property, $PUT_2$ remains conductive until the electric energy in the capacitor has been fully discharged. Further, since the power supply voltage exceeds the zener voltage (27 V) of the zener diode $ZD_1$ in the low voltage protection circuit 5, the zener diode $ZD_1$, $PUT_1$ and $TR_1$ are all made conductive, and thus $TR_2$ is made non-conductive. Therefore, the low voltage protection circuit 5 continues to apply the power supply voltage from the output terminal $P_1$ to the delay circuit 8.

When the power supply voltage $V_0$ is in the normal operation range as illustrated by a curve III in FIG. 2B ($27\ V \leqq V_0 \leqq 39\ V$), the low voltage protection circuit 5 continues to apply the power supply voltage to the delay circuit 8 and the high voltage protection circuit 6 is not actuated and does not produce the inhibit signal. Therefore, the actuation signal is generated at a junction point $P_3$ between the resistors $R_6$ and $R_7$ of the actuation circuit 7 at the timing $t_2$ at which the power supply voltage $V_0$ is stopped. Then the delay circuit 8 initiates to count the clock pulses and generates the igniting signal when the predetermined number of clock pulses has been counted. In this manner, the detonator is exploded at the predetermined timing. It should be noted that the low voltage protection circuit 5 continues to operate normally although the terminal voltage across the capacitor is decreased due to the power consumption at the delay circuit 8, because $PUT_1$ has the self-holding property.

In the low voltage protection circuit 5, the charging time constant of the capacitor 4 is set to be sufficiently larger than the discharging time constant of the load resistor $RL_1$, and therefore the capacitor 4 can be positively charged.

In the electric detonator of delay type according to the invention, the low voltage protection circuit 5 can prevent the detonator from being exploded erroneously even though the capacitor 4 might be charged with stray currents such as low voltage noise, and further the high voltage protection circuit 6 can prevent the detonator from being exploded accidentally even if the leg wires are erroneously connected to a high voltage supply source such as the domestic power supply line, i.e. AC 100 V socket and a voltage supply source for electric motors. Therefore, the electric detonator according to the invention is particularly suitable for city use for destroying large buildings, and further a test for confirming the detonator's properties can be effected very safely.

The present invention is not limited to the embodiment explained above, but may be modified in various ways. In the above embodiment, the low and high voltage protection circuits and other circuits are arranged in the same housing 13, but these circuits may be installed in a separate housing and may be connected to the detonator via the leg wires. Further, the low and high voltage protection circuits may be applied to the primer of delay type.

In the above embodiment, the normal operation range is set to 27–39 V, but the lowest voltage $V_L$ may be set to a value within a range of 3–30 V and the highest voltage $V_H$ may be selected from a range of 8–54 V in accordance with the operation voltage of the circuits. In this case, it is preferable to determine the normal operation range by taking into account a possible variation of the power supply source voltage. Moreover, in order to increase the safeness, the normal operation range has to be set as small as possible.

As explained above in detail, according to the invention, the electric charge stored in the capacitor is forcedly discharged when the power supply voltage is out of the normal operation range, so that the electric detonator can be exploded reliably and safely.

What is claimed is:

1. An electric detonator of delay type comprising a pair of leg wires which are connectable to bus wires connected to a blaster;

a capacitor connected across said leg wires and storing the electric energy supplied from the blaster via the bus wires and the leg wires;

a delay circuit connected to be energized by a terminal voltage generated across said capacitor and generating an igniting signal at a predetermined timing;

a switching circuit connected to be made conductive upon receipt of said igniting signal from said delay circuit and constituting a discharge passage for the electric energy stored in said capacitor;

an igniting resistor connected in said discharge passage and igniting the detonator when the electric energy is discharged through the discharge passage;

a low voltage protection circuit connected across the leg wires and discharging the electric energy stored in the capacitor, when a power supply voltage applied across the leg wires is smaller than the lowest voltage of a normal operation range; and a high voltage protection circuit connected across the leg wires and discharging said electric energy stored in the capacitor when the power supply voltage exceeds the highest voltage of the normal operation range and supplying to said delay circuit an inhibit signal which inhibits a time counting operation of the delay circuit for determining said predetermined timing.

2. A detonator according to claim 1, further comprising an actuation circuit connected across the leg wires and generating an actuation signal when the power supply from the blaster is stopped, said actuation signal being supplied to the delay circuit, said actuation signal initiating the time counting operation in said delay circuit.

3. A detonator according to claim 2, wherein said lower voltage protection circuit comprises a zener diode having a first zener voltage corresponding to the lowest voltage of the normal operation range, and said high voltage protection circuit comprises a second zener diode having a zener voltage corresponding to the highest voltage of the normal operation range.

4. A detonator according to claim 2, wherein said actuation circuit comprises a series circuit of first and second resistors and a first diode connected across the leg wires, and a second diode connected in series with one of the leg wires, whereby said actuation signal is generated at a junction point between the first and second resistors.

* * * * *